United States Patent [19]

Reth et al.

[11] Patent Number: 4,555,923

[45] Date of Patent: Dec. 3, 1985

[54] MOUNTING OF ROLLED STOCK GUIDING FACILITIES

[75] Inventors: Erich Reth; Wilhelm Hoenmanns, both of Duisburg, Fed. Rep. of Germany

[73] Assignee: Mannesmann AG, Duesseldorf, Fed. Rep. of Germany

[21] Appl. No.: 563,974

[22] Filed: Dec. 21, 1983

[30] Foreign Application Priority Data

Dec. 22, 1982 [DE] Fed. Rep. of Germany ..... 3247485

[51] Int. Cl.[4] ..... B21B 39/16

[52] U.S. Cl. ..... 72/250

[58] Field of Search ..... 72/429, 250

[56] References Cited

U.S. PATENT DOCUMENTS

| | | | |
|---|---|---|---|
| 3,798,952 | 3/1974 | Easter | 72/250 |
| 4,471,642 | 9/1984 | Wilson | 72/250 |

FOREIGN PATENT DOCUMENTS

| | | | |
|---|---|---|---|
| 1527756 | 7/1973 | Fed. Rep. of Germany . | |
| 106619 | 8/1980 | Japan | 72/250 |
| 133815 | 10/1980 | Japan | 72/250 |
| 94416 | 6/1982 | Japan | 72/250 |

*Primary Examiner*—Lowell A. Larson
*Assistant Examiner*—Jorji M. Griffin
*Attorney, Agent, or Firm*—Ralf H. Siegemund

[57] ABSTRACT

The guiding facilities for rolled stock in a sizing mill are mounted on a pivotable carrier, which in turn is excentrically mounted on a shaft with excentric pivot. Rotation of the shaft adjusts the elevation. The shaft is mounted to a base in relation to which the roll stand is literally slideable.

2 Claims, 1 Drawing Figure

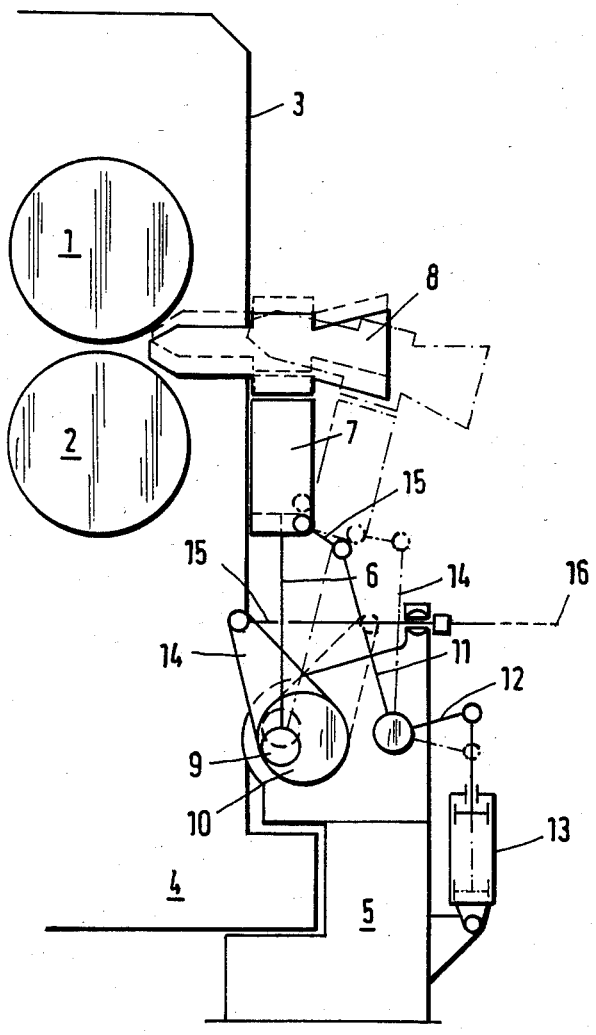
3
1
8
2
7
15
15
6
14
16
14
11
12
9
10
13
4
5

MOUNTING OF ROLLED STOCK GUIDING FACILITIES

BACKGROUND OF THE INVENTION

The present invention relates to a carrier for guiding rolling stock in a sizing mill to be supported in a rolling stand in a manner permitting secure positioning during rolling but pivoting out of the way for removing the rolls.

Proposals have been made concerning generally the problem of exchange and adjusting of guidance and guiding facilities for the rolled stock in sizing mills. Generally the exchange of rolls requires also an exchange of the guiding structure or at least a shifting thereof on the respective carrier, because subsequently the guiding of the rolling stock has to be different. The German printed patent application, 1527756, proposes a carrier for the guiding facilities which can easily be exchanged. The principle employed here is to provide a girder in a frame which can easily be taken off, but is inserted in a pivot mount on the rolling stand which mount is open at the top. The girder or carrier can be secured to the rolling stand through flaps. The carrier configuation, therefore, is constructed so that in the case of a change in the sizing dimensions a new frame with prepared rolling stock guiding facility can be rapidly inserted in a very simple manner and the time consuming shifting of the guiding facilities on the carrier is no longer necessary. On the other hand, the known construction is disadvantaged by the fact that for installation and removal of the carrier at the rolling stand one needs a crane which detrimentally interferes, i.e. extends the overall period of time required for exchanging rolls. Also, this crane is needed to provide the elevation of the pivot mount at the rolling stand in order to adjust the position of the carrier. Therefore, this arrangement requires an exact positioning of the lower roll before the exchange procedure can take place.

DESCRIPTION OF THE INVENTION

It is an object of the present invention to provide a new and improved carrier for sizing facilities in a rolling mill of the sizing variety which permits reduction in the period of time required to exchange the rolls and related equipment in the stand whereby particularly sliding of the rolling stock guiding facilities is to be avoided, but permitting also a matching of the elevation concerning any elevational differences in the lower one of the rolls.

It is, therefore, an object of the present invention to improve generally the state of the art as evidenced by the above mentioned German-printed patent application, 1527756.

It is, therefore, a specific object of the present invention to provide a new and improved carrier configuration for the rolling stock guiding facilities in a sizing mill whereby this carrier is to be provided with a definite position with respect to the rolling stand and can be pivoted away for purposes of facilitating exchange of rolls.

In accordance with the preferred embodiment of the present invention, it is suggested to improve an arrangement in accordance with the specific object by providing the carrier in an elevationally adjustable mount in relation to a base, bottom or floor plate of the rolling stand. In other words, the carrier for the guiding facilities in a sizing mill is no longer directly arranged on the rolling stand, but is arranged in accordance with a bottom plate or bottom platform at the rolling stand. This feature permits the carrier to be retained in its position with respect to the center of rolling so that it is not necessary to shift it in relation to the stand and therefore does not have to be disassembled when the rolling stand is to be shifted.

In accordance with a further feature of the invention, it is suggested to adjust the elevation of the carrier through an excenter and crank-like shaft which is journalled horizontally in the bottom and base plate. This shaft is rotated through suitable power facilities, such as a hydraulic drive or the like. This feature makes feasible in a simple manner that the carrier can be lifted or lowered by small amounts simply through rotation of the cam or crank shaft in order to adjust the guiding facilities on the carrier to the respective elevational level of the lower roll. Another power drive is provided for pivoting the carrier away from the roll stand and about the pivot mount which bears against the cam or crank shaft. This power drive is provided between the carrier and the bottom-mounting and floor plate.

The elevational adjustment of the rolling stock guiding facilities, as well as the pivoting of the carrier with these facilities, is thus provided separately from the rolling stand. Therefore, the rolling stand can be shifted or adjusted in relation to the floor plate without effecting the position of the rolling stock guiding facilities in relation to the center of rolling. It is now merely necessary to pivot the carrier away in order to remove at least a portion of the guiding facilities from the range of the rolling window whenever the rolls themselves have to be shifted.

It can readily be seen that the invention offers the advantage of reducing the period of time it takes to refurbish the stand, for example, with different rolls whereby particularly readjustment is carried out in a very simple fashion or can be avoided entirely. Moreover, one does not need anymore any crane or other external facility for exchanging the carrier for the rolling stock guiding facilities.

DESCRIPTION OF THE DRAWINGS

While the specification concludes with claims, particularly pointing out and distinctly claiming the subject matter which is regarded as the invention, it is believed that the invention, the objects and features of the invention, and further objects, features and advantages thereof, will be better understood from the following description taken in connection with the accompanying drawings in which the FIGURE illustrates somewhat schematically a side view of the preferred embodiment of the present invention for practicing the best mode thereof.

Proceeding now to the details of the description of the drawings, a rolling stand 3 is schematically indicated and it includes two sizing rolls denoted with Refs. 1 and 2. The foot of the rolling stand 3 is mounted in a bottom or floor plate 5 and can be slided and shifted in a direction transversely to the plane of the drawing. Ref. 6 refers generally to the carrier for the guiding facilities which includes a rolling girder 7, and rolling stock guiding facilities 8 are mounted thereon. The FIGURE illustrates a normal operating position in solid lines while the dash dot lines indicate for the elements 6, 7 and 8 those positions in which these parts are pivoted away from the rolling stand. The dotted position, in addition, is indicative of a different elevational adjustment of the elements 6, 7 and 8.

Ref. 9 refers to a pivot mount for the carrier 6 which pivot mount 9 is pivotally linked eccentrically on the shaft 10. A two-arm swivel lever 11 is provided, having one arm 12 connected to a hydraulic power drive 13. The other arm 14 of the two-arm lever 11 is linked to a linkage lever 15 which, in turn, is articulated or otherwise suitably connected to the girder or bar 7. But the bar 7, together with the carrier 6 and the guiding facilities 8, can be pivoted about the axis of the mount 9 in order to pivot the elements 6, 7 and 8 away from the rolling stand 3.

Aside from the above mentioned pivot of this structure, the crank shaft 10, already introduced as a part of the pivot mount, is also mounted and journalled for horizontal extension and on the bottom plate and bottom structure 5. As stated, the pivot mount 9 is eccentrically disposed with respect to the axis of rotation of the excenter crankshaft 10. The shaft 10 can be turned by means of a lever 14 which is actuated by a tension rod 15, which in turn is operated by a power drive 16. Upon operating the power drive 16 and turning the shaft 10, the vertical elevational level of the pivot mount 9 is varied in up-and-down direction, so that the carrier 6 with the guide facilities 8 are moved up and down, for example, from the solidly drawn position to the position drawn in dotted lines.

In order to compensate for any inaccuracies and tolerances with regard to the shaft 10 and its mounting, as well as its relation to the frame 3 on one hand and the bar 7 on the other hand, a cam shim of the like may be provided on the cam portion of shaft 10.

The pivot drive 13 is a hydraulic cylinder arrangement and has a fairly low operating speed with adequate attentuation in the terminal positions. Preferably, one may include a locking device (not shown) in terms of suitable switches, for blocking the frame shift cylinder whenever the facilities 8 are in the forward position, i.e. within the range of the rolling frame. It should be noted that in this case, the bar 7 is usually bolted to the rolling stand 3.

The invention is not limited to the embodiments described above, but all changes and modifications thereof not constituting departures from the spirit and scope of the invention are intended to be included.

We claim:

1. In a sizing mill having a stand with sizing rolls, the combination comprising a bottom support facility, the rolling stand being laterally slidably mounted in said bottom facility;

carrier means pivoted on said bottom facility and carrying rolling stock guidance means, the carrier provided for pivoting the guiding means toward and away from said rolls in said rolling stand;

means including a shaft journalled in said bottom facility serving as an eccentric pivot mount for said carrier for vertically adjusting a pivot point of the pivot mount of said carrier in relation to said bottom facility to thereby adjust the elevational level of the guiding means upon turning of the shaft in relation to the rolls in said stand; and power drive means connected for turning the shaft.

2. The improvement as in claim 1 and wherein said power drive means is interposed between said bottom facility and said carrier for pivoting the carrier and its pivot mount on said shaft.

* * * * *